US008448794B1

(12) United States Patent
Wang

(10) Patent No.: US 8,448,794 B1
(45) Date of Patent: May 28, 2013

(54) SUSPENSION CLOSET

(76) Inventor: I-Chen Wang, Taipei (TW)

( * ) Notice: Subject to any disclaimer, the term of this patent is extended or adjusted under 35 U.S.C. 154(b) by 0 days.

(21) Appl. No.: 13/441,915

(22) Filed: Apr. 9, 2012

(51) Int. Cl.
*A47F 5/08* (2006.01)
*B65D 85/18* (2006.01)

(52) U.S. Cl.
USPC ..... 211/118; 206/286; 206/287.1; 206/298

(58) Field of Classification Search
USPC ..... 211/118, 85.3, 195, 85.24, 200, 180, 211/85, 324; 312/3, 4, 5, 6; 108/99, 162, 108/164; 383/38, 22; 206/286, 287.1, 292, 206/298
See application file for complete search history.

(56) References Cited

U.S. PATENT DOCUMENTS 2,351,882 A * 6/1944 Schwartzman ..... 206/287
2,372,439 A * 3/1945 Lofgren ..... 206/287
5,071,003 A * 12/1991 Freelander ..... 206/282

* cited by examiner

*Primary Examiner* — Jonathan Liu
*Assistant Examiner* — James Twomey
(74) *Attorney, Agent, or Firm* — Leong C. Lei

(57) ABSTRACT

A suspension closet includes a closet body that is made of a flexible sheet of fabric and has a top end opening. Two opposite side walls of the top opening of the closet body are respectively provided with fastening elements and form opposing cutouts. To assemble the closet, the opposing cutouts of the closet body are fit with a suspension bar first and a frame is disposed in the closet body to be coupled to the fastening elements. A top cover is then set to cover the top end opening of the closet body. In this way, the closet body can be efficiently and effectively suspended on the suspension bar.

5 Claims, 10 Drawing Sheets

SUSPENSION CLOSET

TECHNICAL FIELD OF THE INVENTION

The present invention generally relates to a structure that allows a closet to be easily suspended on a suspension bar and also easily removable from the suspension bar.

DESCRIPTION OF THE PRIOR ART

In area where the resident space is limited, the space of a wardrobe or cabinet is also limited. Thus, suspension closets that provide additional space for storage of clothes or small articles are prevailing. A conventional simply-structured suspension closet is generally made of a fabric that is of sufficient strength and flexibility and the structure is simply such that the fabric encloses in multiple directions to define closet body that has an interior space. The interior space may then be further partitioned to define a plurality of sub-spaces. The conventional suspension closet is often provided with holes that work with hangers to suspend the suspension closet in a wardrobe or on a suspension bar. Some models of suspension closets available in the market additionally include hook-and-loop fasteners that are provided at a top end of the closet body to attach to the suspension bar in a wardrobe or cabinet. This increases the complexity of the suspension closet structure and thus raises the costs.

SUMMARY OF THE INVENTION

An object of the present invention is to overcome the problems of complicated structure and high manufacturing cost of the conventional suspension closet that is made of flexible sheet of fabric and must include a rigid hanger, such as one made of steel wire, to hang clothes.

The feature of the present invention is to provide an arrangement in which a suspension bar of a wardrobe or cabinet is directly received in a closet body of a suspension closet and frame coupling structure is provided on the closet body so that the closet body can be directly suspended on the suspension bar and the suspension bar can be used to hang clothes, whereby the structure of the suspension closet is simplified and the manufacturing cost reduced.

The technical solution of the present invention comprises a closet body that is made of a flexible sheet of fabric and has a top end opening. Two opposite side walls of the top opening of the closet body are respectively provided with fastening elements and form opposing cutouts. To assemble the closet, the opposing cutouts of the closet body are fit with a suspension bar first and a frame is disposed in the closet body to be coupled to the fastening elements. A top cover that is provided at a top edge of a rear wall between the two opposite side walls is then set to cover the top end opening of the closet body and is releasably attached to front top edges of the two opposite side walls. In this way, the suspension bar is set under and supports the frame so as to suspend the closet body on the suspension bar.

To provide the closet body with bettered fixing strength on the suspension bar, the fastening elements provided on the side walls of the top opening of the closet can be hook-and-loop fasteners or buttons to efficiently and effectively suspend the closet body to the suspension bar.

The present invention allows the cutouts in the upper portions of the closet body to directly fit with a suspension bar and uses a frame to support so that the hangers that are used in the conventional suspension closet for hanging clothes can be eliminated. Thus, the manufacturing cost is reduced and assembling/disassembling can be carried out efficiently and conveniently. Easy collapse is also possible for easy storage when the closet is not in use and this is convenient and practical to the general consumers.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
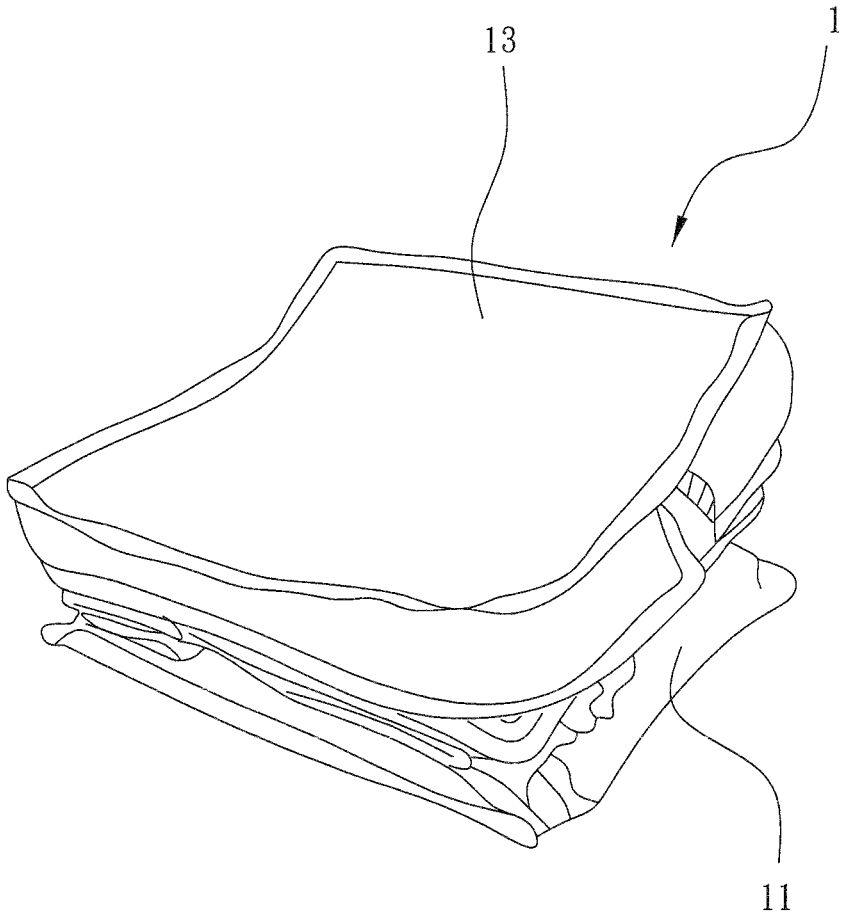
FIG. 1 is a perspective view showing a suspension closet according to an embodiment of the present invention in a collapsed condition.
Figure 2:
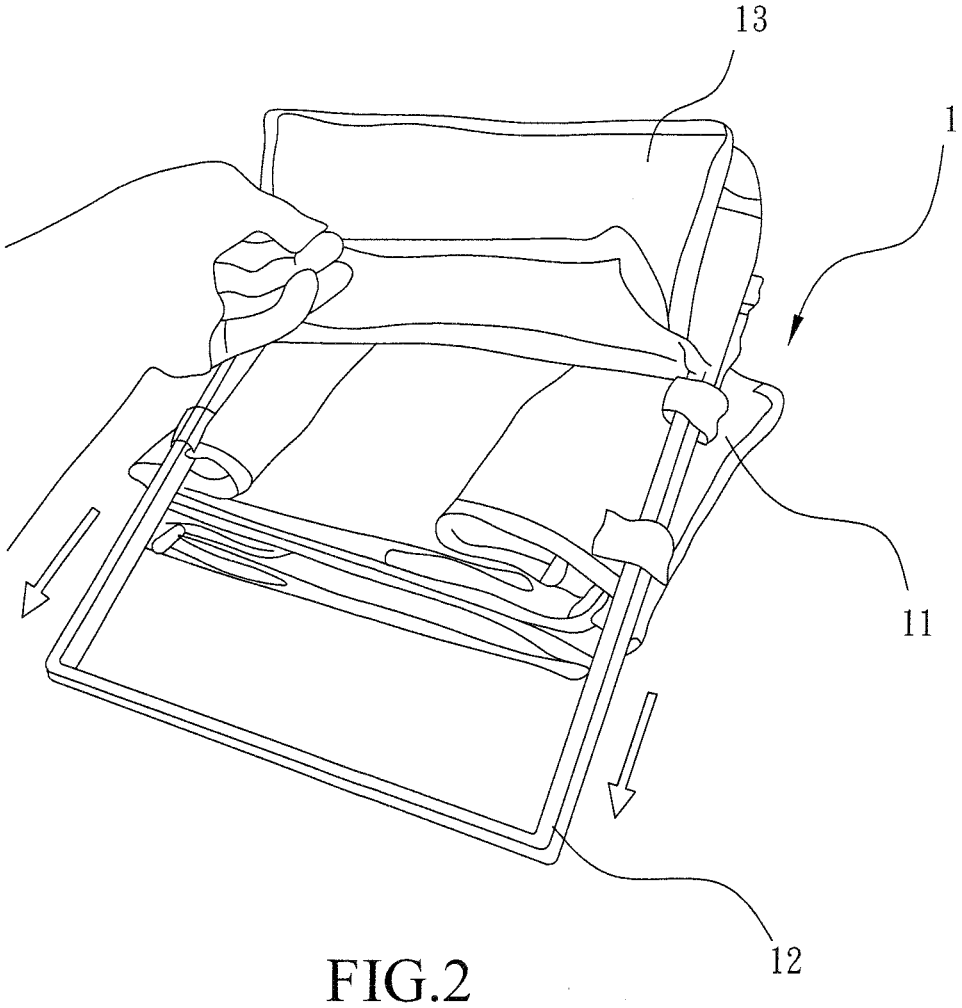
FIG. 2 is a perspective view showing expanding of the closet of the present invention.
Figure 2A:
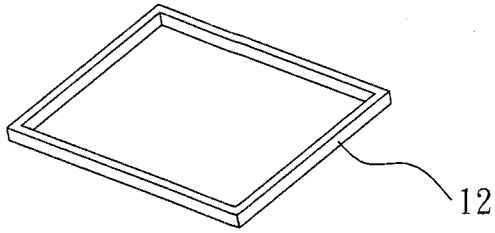
FIG. 2A is a perspective view showing a frame of the closet according to the present invention.
Figure 3:
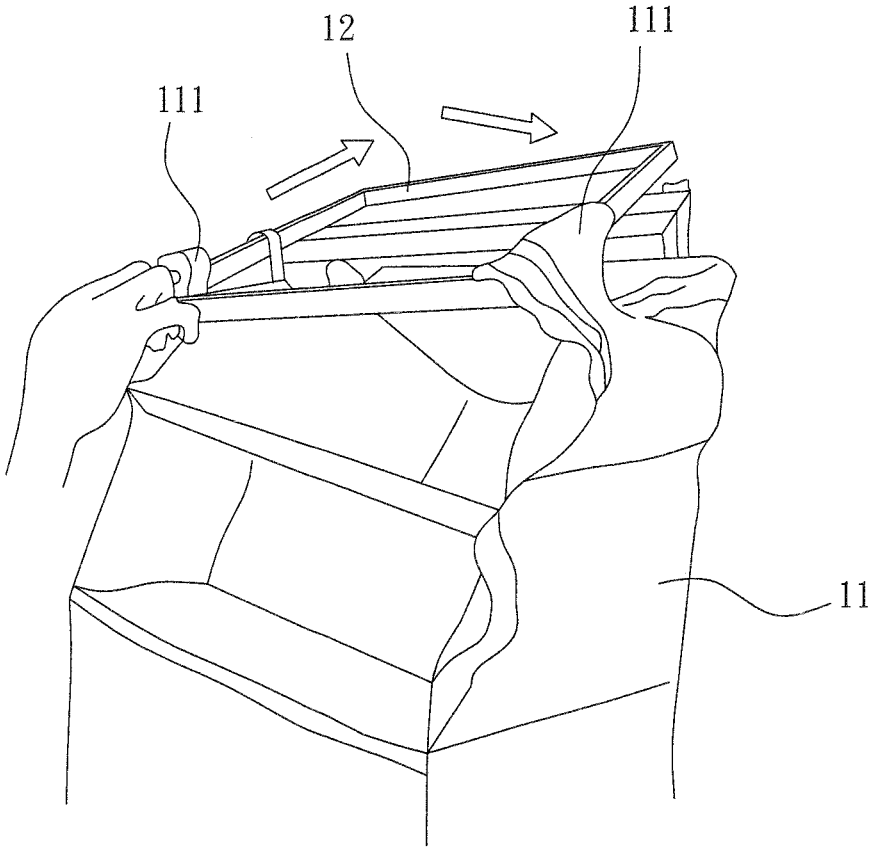
FIGS. 3 and 4 are perspective views showing assembling of a closet body and the frame of the closet according to the present invention.
Figure 4:
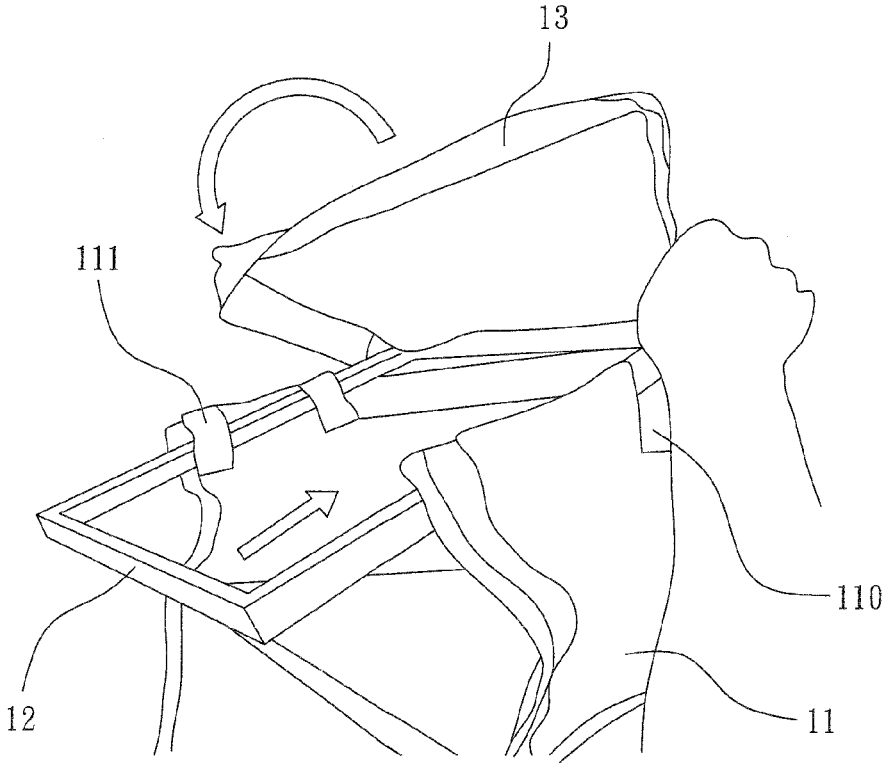
Figure 5:
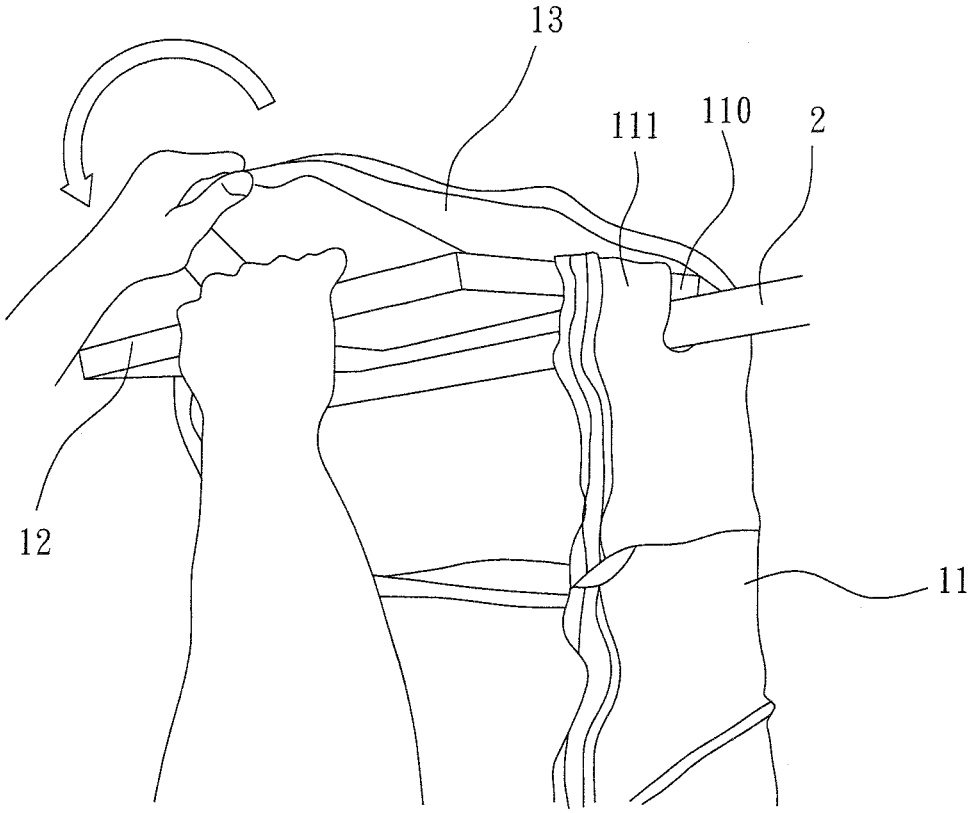
FIG. 5 is a perspective view showing the assembling of the closet body of the closet according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in the drawings, the present invention provides a suspension closet, which comprises a closet body that is made of a flexible sheet of fabric and defines therein an article storage space. The suspension closet, generally designated at 1, comprises a closet body 11, a frame 12, and a top cover 13.

Figure 6:
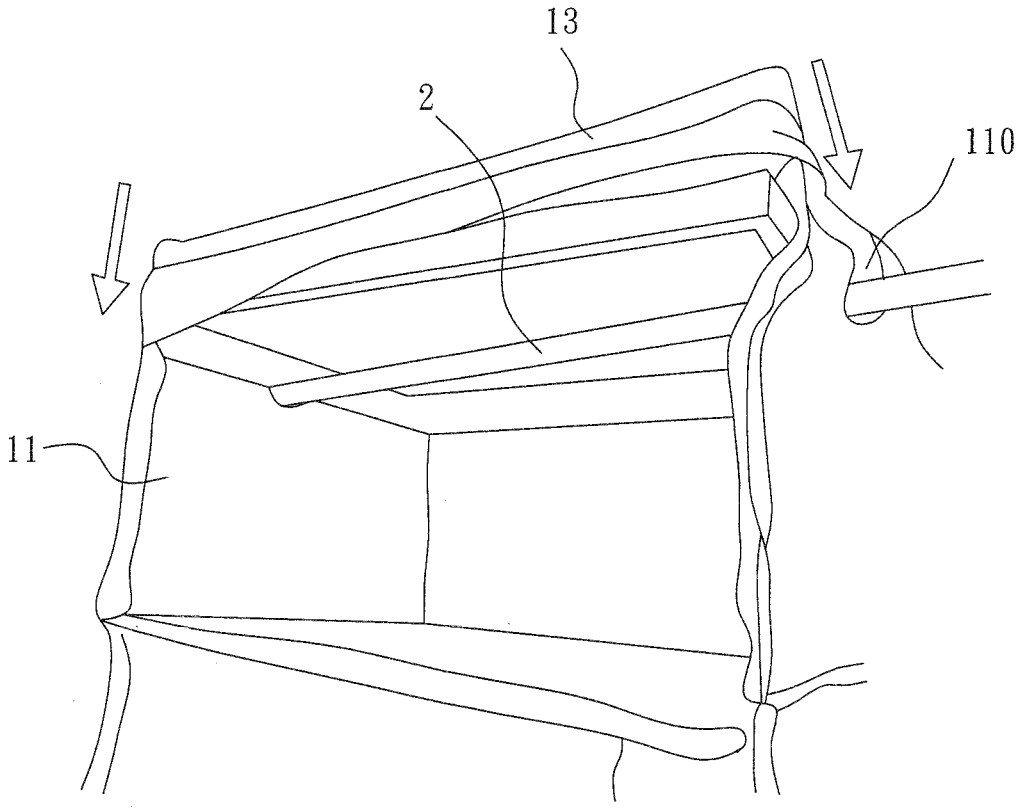
FIG. 6 is a perspective view showing the assembling of the closet body of the closet according to the present invention.
Figure 7:
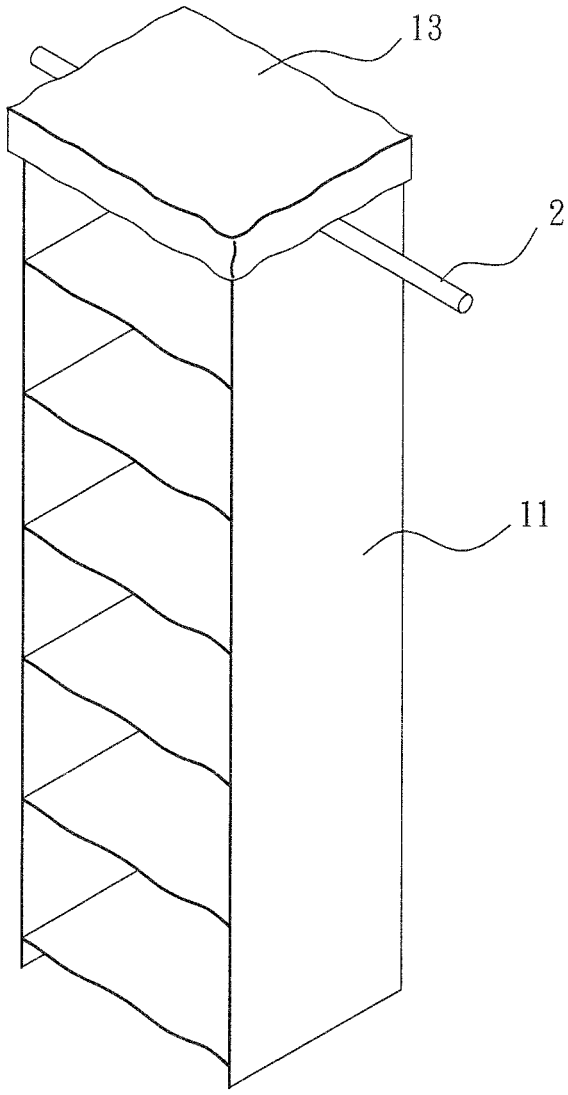
FIG. 7 is a perspective view showing the closet body suspended on a suspension bar according to the present invention.

The closet body 11 has a top end opening of which two opposite side walls are respectively provided with a plurality of fastening elements 111 and define opposing cutouts 110 in upper potions thereof, wherein each of the opposite side walls is provided with at least two fastening elements 111 symmetrically located at two sides of the corresponding cutout 110. The fastening elements 111 can be hook-and-loop fastener or buttons or sewed strips. The top cover 13 is provided at a top edge of a rear wall between the two opposite side walls of the closet body 11. To use, the closed body 11 is first expanded and the opposing cutouts 110 formed in the upper portions of the side walls of the closet body 11 are fit, in a direction from lower side to upper side, with a suspension bar 2. The frame 12 is then positioned into the top opening of the closed body 11 to allow the fastening elements 111 that are provided on the two opposite side walls of the top opening of the closed body to couple and fix to the frame 12, wherein the suspension bar 2 can be located and confined between the fastening elements 111, and the fastening elements 111 at each side wall of the closet body 11 are affixed to one corresponding side of the frame 12. Finally, the top cover or movable top cover 13 that is provided at the rear wall between the two opposite side walls of the closet body 11 is lifted to cover the top end opening of the closed body 11 and is releasably attached to front top edges of the two opposing side walls. The suspension bar 2 is set under and supports the frame 12 to provide a sufficient strength of support (as shown in FIGS. 6 and 7). In addition, as shown in FIGS. 2, 2A, 3, and 4, the frame 12 can be a hollow rectangular body to facilitate attachment of the fastening elements 111.

Figure 8:
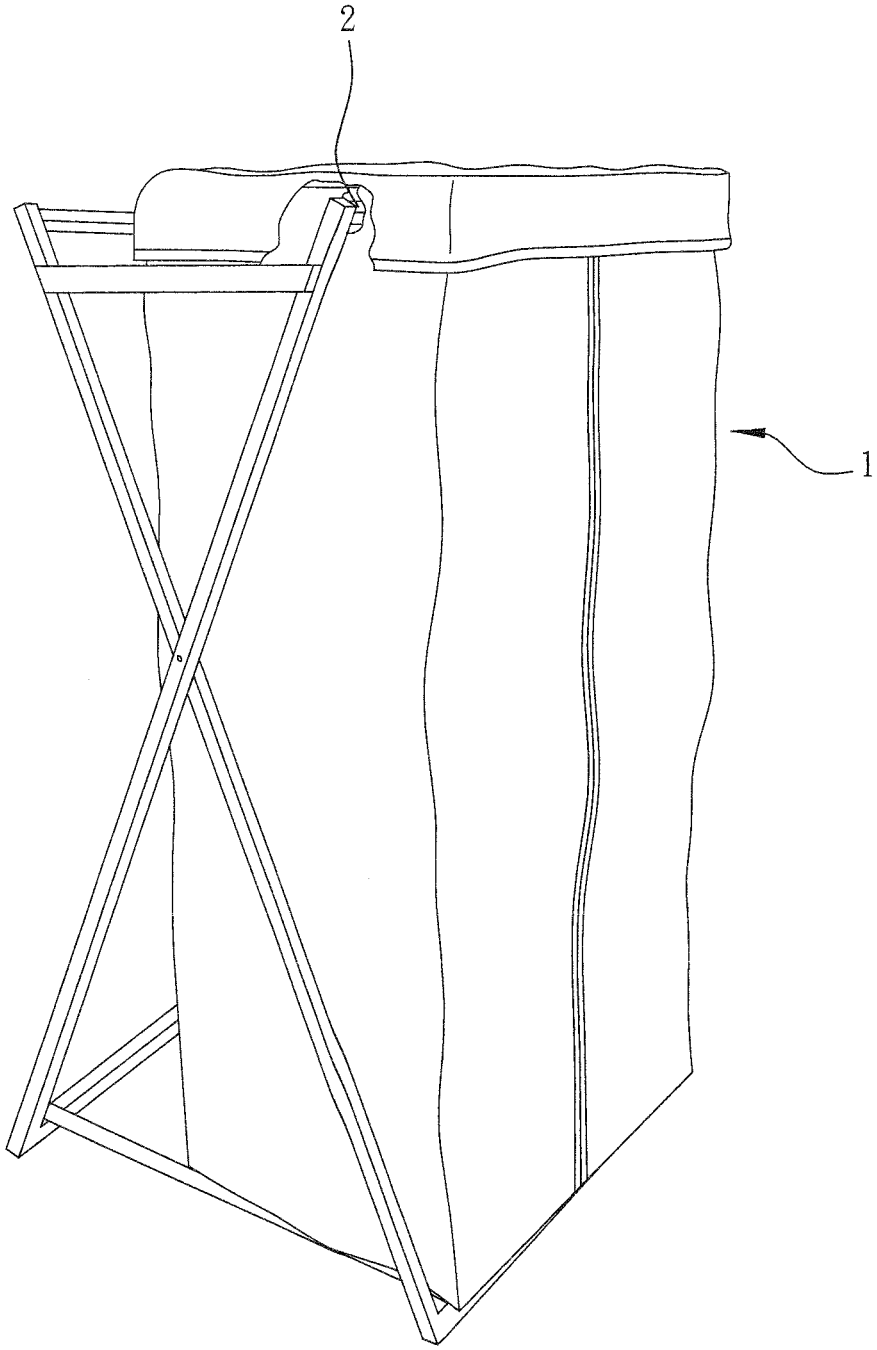
FIG. 8 is a perspective view showing a closet body suspended on support frames that are expanded in an X-shape according to another embodiment of the present invention.

The present invention can be embodied in various way of suspension. For example, as shown in FIG. 8, two pivotally jointed rectangular frames are included. The two rectangular frames are each provided with a suspension bar 2 at a top end thereof. The two rectangular frames can be rotated to expand for standing on the ground or may be collapsed for closing and easy storage.

FIG. 8 shows the assembly of a suspension closet 1 according to the present invention combined with support frames to be suspended thereby, where the opposing cutouts 110 formed in upper portions of the side walls of the closed body 11 are fit, in a direction from lower side to upper side, with the suspension bar 2 of the top end of one of the support frames and then the plurality of fastening elements 111 that are provided on the two opposite side walls of the top opening of the closed body 11 are coupled to and fixed to the frame 12. Finally, the top cover 13 is set to cover the top end opening of the closet body 11 and is releasably attached to front top edges of the two opposite side walls of the closet body 11. As such, the suspension bar 2 of the support frames is set under and supports the frame 12 and the frame 12 expands the top cover 13 of the closet body 11 to form an interior space inside the closet body 11.

Figure 9:
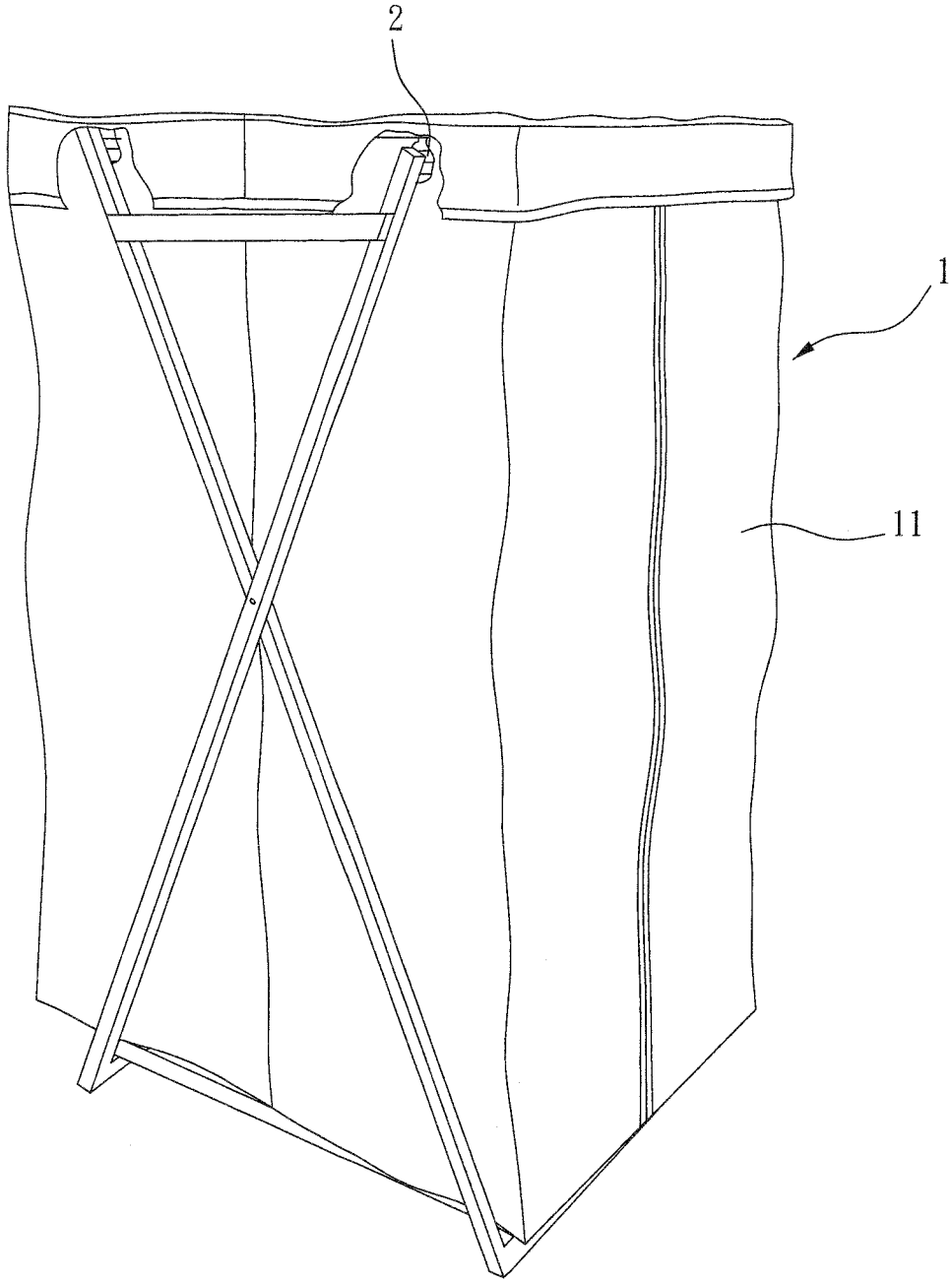
FIG. 9 is a perspective view showing two closet bodies suspended on support frames that are expanded in an X-shape according to a further embodiment of the present invention.

FIG. 9 shows an example in which the present invention is embodied in such a way that two closets 1 of the present invention are respectively suspended on the two suspension bars 2 of the support frames that are expanded to show an X-configuration so that the available volume of the closet can be expanded. In this embodiment, the assembling of the closet body 11 and the suspension bar 2 of the support frame is exactly the same as the previous embodiment and the only difference is the number of the closet body 11 is increased.

Figure 10:
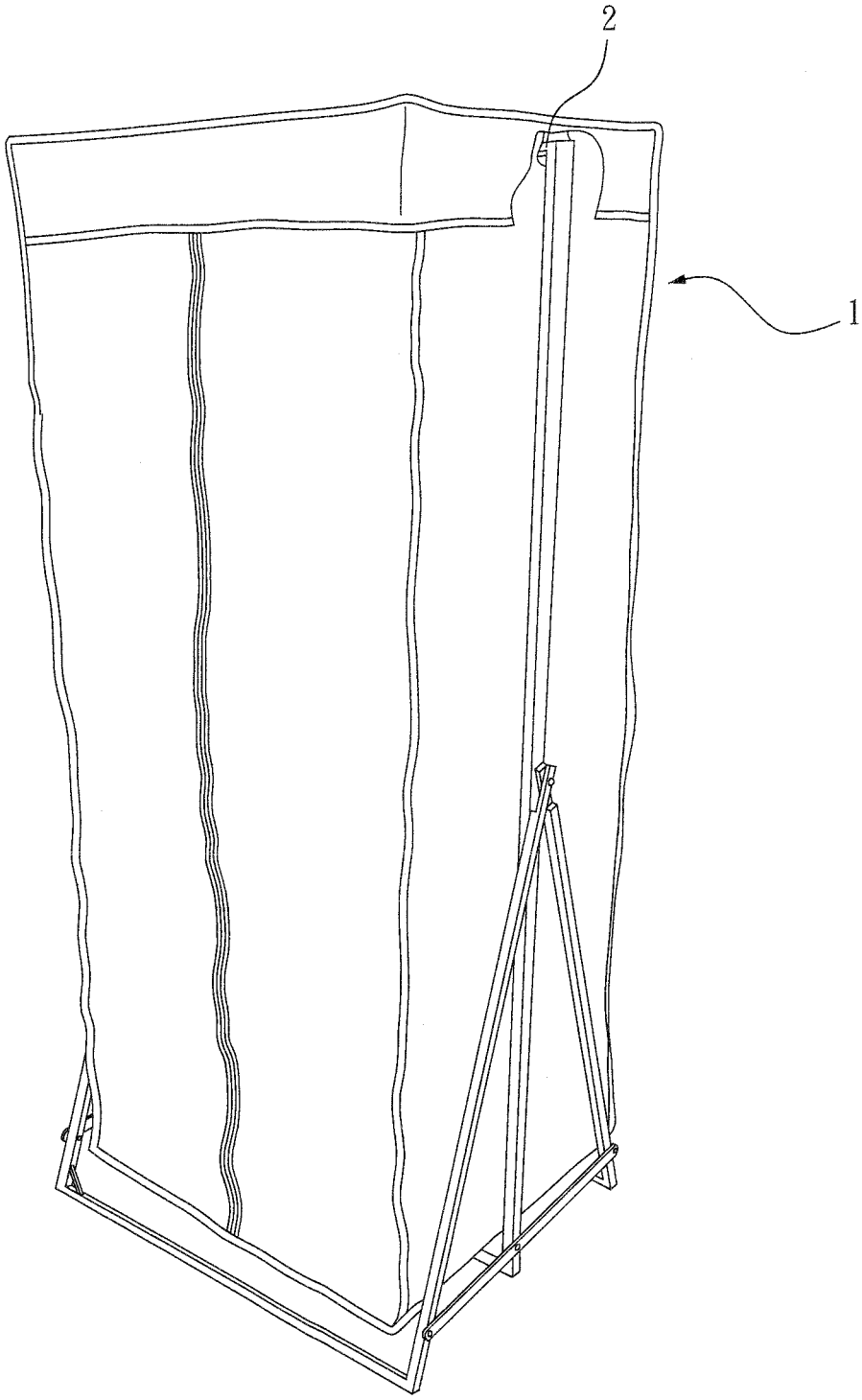
FIG. 10 is a perspective view showing a closet body suspended on support frames that are expanded in an inverted Y-shape according to yet a further embodiment of the present invention.

FIG. 10 shows an embodiment in which the support frames are arranged to show an inverted Y-shaped configuration after expanded and the support frames comprise a suspension bar 2 that is mounted between upper ends of the support frames. The closet 1 can be suspended in the same way on the suspension bar 2.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A suspension closet, comprising:

a closet body, which has a top end opening of which two opposite side walls form opposing cutouts, each of the opposite side walls being provided with at least two fastening elements symmetrically located at two sides of its cutout, wherein the cutouts are fit, in a direction from lower side to upper side, with a suspension bar, and the fastening elements are coupled with a frame placed over the suspension bar in such a way that the fastening elements at each side wall of the closet body are affixed to one corresponding side of the frame, so that the suspension bar is located and confined between the fastening elements, and the frame together with the closet body is supported by the suspension bar, and wherein a top cover, being provided at a top edge of a rear wall between the two opposite side walls, is releasably attached to each front edges of the two opposite side walls for covering the top end opening of the closet body.

2. The suspension closet according to claim 1, wherein the frame is a hollow rectangular body.

3. The suspension closet according to claim 2, wherein the top fastening elements are sewed strips.

4. The suspension closet according to claim 2, wherein the fastening elements are hook-and-loop fasteners.

5. The suspension closet according to claim 2, wherein the fastening elements are buttons.

* * * * *